US009075335B2

(12) United States Patent
Hata

(10) Patent No.: US 9,075,335 B2
(45) Date of Patent: Jul. 7, 2015

(54) IMAGE FORMING APPARATUS, INCLUDING A SHIELDING MEMBER, THAT FORMS IMAGE BY DEVELOPING ELECTROSTATIC LATENT IMAGE FORMED ON PHOTOSENSITIVE MEMBER

(75) Inventor: Yousuke Hata, Ichikawa (JP)

(73) Assignee: CANON KABUSHIKI KAISHA (JP)

( * ) Notice: Subject to any disclaimer, the term of this patent is extended or adjusted under 35 U.S.C. 154(b) by 101 days.

(21) Appl. No.: 13/344,840

(22) Filed: Jan. 6, 2012

(65) Prior Publication Data

US 2012/0177394 A1 Jul. 12, 2012

(30) Foreign Application Priority Data

Jan. 11, 2011 (JP) ..... 2011-003079

(51) Int. Cl.

| | |
|---|---|
| ***G03G 15/20*** | (2006.01) |
| ***G03G 15/02*** | (2006.01) |
| ***G03G 21/16*** | (2006.01) |
| ***G03G 21/20*** | (2006.01) |

(52) U.S. Cl.

CPC ..... *G03G 15/0291* (2013.01); *G03G 21/1671* (2013.01); *G03G 21/20* (2013.01)

(58) Field of Classification Search

USPC ..... 399/38, 50, 100, 115, 128, 168, 170, 399/171–176, 116, 207, 315, 317

See application file for complete search history.

(56) References Cited

U.S. PATENT DOCUMENTS

| | | | | |
|---|---|---|---|---|
| 5,325,209 | A * | 6/1994 | Manabe | 358/437 |
| 7,220,522 | B2 * | 5/2007 | Ikegami et al. | 430/73 |
| 2003/0044186 | A1 * | 3/2003 | Kato et al. | 399/16 |
| 2009/0136253 | A1 * | 5/2009 | Nakajima et al. | 399/100 |
| 2014/0212175 | A1 | 7/2014 | Makino et al. | |

FOREIGN PATENT DOCUMENTS

| | | | |
|---|---|---|---|
| JP | 2001066914 | A | 3/2001 |
| JP | 2007-072212 | A | 3/2007 |
| JP | 2007072212 | A * | 3/2007 |
| JP | 2010145840 | A | 7/2010 |

OTHER PUBLICATIONS

JP 2007072212 Machine Translation.*

(Continued)

*Primary Examiner* — Clayton E Laballe
*Assistant Examiner* — Victor Verbitsky
(74) *Attorney, Agent, or Firm* — Rossi, Kimms & McDowell LLP

(57) ABSTRACT

An image forming apparatus capable of preventing deterioration of a shielding member due to heat and preventing the occurrence of image failure or the like. The shielding member is capable of shielding a photosensitive member and an electrostatic charger from each other. The electrostatic charger electrostatically charges the photosensitive member. When a detecting unit detects the shielding member being at a retracted position retracted from a shielding position, the heater is caused to heat the photosensitive member, and when the detecting unit detects the shielding member being at the shielding position, the heater is caused to stop heating the photosensitive member.

1 Claim, 8 Drawing Sheets

(56) References Cited

OTHER PUBLICATIONS

JP_2007072212_A_H Machine Translation.*

Office Action issued in JP2011-003079 mailed Sep. 22, 2014. English translation provided.

* cited by examiner

*FIG. 4*

| | | DRUM HEATER SWITCH | |
|---|---|---|---|
| | | OFF | ON |
| MAIN SWITCH | OFF | OFF | ON |
| | ON | OFF | AS CONTROLLED BY CPU |

IMAGE FORMING APPARATUS, INCLUDING A SHIELDING MEMBER, THAT FORMS IMAGE BY DEVELOPING ELECTROSTATIC LATENT IMAGE FORMED ON PHOTOSENSITIVE MEMBER

BACKGROUND OF THE INVENTION

1. Field of the Invention

The present invention relates to an image forming apparatus that forms an image by developing an electrostatic latent image formed on a photosensitive member, and is applied to a copier, a printer, or the like.

2. Description of the Related Art

Conventionally, methods for electrostatically charging a photosensitive member on which an electrostatic latent image is formed before an image which is to be transferred to a recording sheet in an image forming apparatus is developed include a corona electrostatic charging method. The corona electrostatic charging method is a method that a high voltage of about 5 kV to 10 kV is applied to a metallic wire with a diameter of about 50 μm to 100 μm placed inside a corona electrostatic charger disposed in opposing relation to a photosensitive member, and an air layer between the photosensitive member and the corona electrostatic charger is ionized by corona discharge to electrostatically charge the photosensitive member.

With repeated discharge, stains become attached to the metallic wire itself to deteriorate discharging performance, and hence it is necessary to clean and replace the metallic wire on a regular basis. Moreover, corona products are produced due to ozone generated by corona discharge, and a surface of the photosensitive member tends to gradually absorb moisture due to the corona products.

Also, ozone products are generated due to reaction of ozone generated due to corona discharge and moisture in the air, and become attached to the photosensitive member tending to absorb moisture. The resistance of the surface of the photosensitive member decreases due to the ozone products, and image deletion (such as image blur or distortion) occurs due to insufficient electrostatic charging of the photosensitive member when an electrostatic latent image is formed on the photosensitive member.

The techniques described hereafter have been proposed so as to prevent such image deletion. They include the technique that moisture on the surface of the photosensitive member is removed by constantly heating the photosensitive member using a heater, and the technique that a shielding member is disposed between the photosensitive member and an electrostatic charger so as to prevent ozone products generated in the neighborhood of the metallic wire from becoming attached to the photosensitive member and its vicinity. It should be noted that cloth or the like is used as the shielding member.

The technique described hereafter has also been proposed so as to prevent such image deletion (see, for example, Japanese Laid-Open Patent Publication (Kokai) No. 2007-072212). According to Japanese Laid-Open Patent Publication (Kokai) No. 2007-072212, during an energy-saving mode in which power consumed by an image forming apparatus is saved, a shielding member is disposed at a shielding position between a photosensitive member and an electrostatic charger instead of heating the photosensitive member by a heater. This prevents image deletion while cutting down on power consumed by the image forming apparatus as compared to a case where electric current is constantly passed through the heater.

However, according to the above described techniques, for example, when the user turns on a switch that activates the heater for the photosensitive member during the energy saving mode in which the shielding member is disposed at the shielding position between the photosensitive member and the electrostatic charger, the photosensitive member is heated with the shielding member being disposed at the shielding position. In this case, the temperature of the shielding member increases because it is fanned by heat generated from the heater for the photosensitive member, and this brings about deterioration of the shielding member.

As a result, the shielding member cannot normally work, causing a phenomenon such as image failure. For example, when the shielding member is hardened by heat, and cannot normally move from a shielding position to the retracted position, the shielding member is left inside an image-forming region to inhibit the photosensitive member form normally working and thus cause a phenomenon in which, for example, an image is partially chipped.

SUMMARY OF THE INVENTION

The present invention provides an image forming apparatus capable of preventing deterioration of a shielding member due to heat and preventing the occurrence of image failure or the like.

Accordingly, a first aspect of the present invention provides an image forming apparatus comprising a photosensitive member, a heater configured to heat the photosensitive member, an electrostatic charger configured to electrostatically charge the photosensitive member, a shielding member configured to shield the photosensitive member and the electrostatic charger from each other, a moving unit configured to move the shielding member to a shielding position between the photosensitive member and the electrostatic charger and a retracted position retracted from the shielding position, a detecting unit configured to detect a position of the shielding member moved by the moving unit, a control unit configured to cause the heater to heat the photosensitive member when the detecting unit detects the shielding member being at the retracted position, and cause the heater to stop heating the photosensitive member when the detecting unit detects the shielding member being at the shielding position.

Accordingly, a second aspect of the present invention provides an image forming apparatus comprising a photosensitive member, a heater configured to heat the photosensitive member, an electrostatic charger configured to electrostatically charge the photosensitive member, a shielding member configured to shield the photosensitive member and the electrostatic charger from each other, a moving unit configured to move the shielding member to a shielding position between the photosensitive member and the electrostatic charger or a retracted position retracted from the shielding position, a detecting unit configured to detect a position of the shielding member moved by the moving unit, a control unit configured to, when the detecting unit detects the shielding member being at the shielding position, control the heater to reduce an amount of heat added to the photosensitive member as compared to a case where the detecting unit detects the shielding member being at the retracted position.

According to the present invention, because electric current is passed through the heater when the shielding member is at the retracted position, and the passage of electric current through the heater is interrupted when the shielding member is at the shielding position. Therefore, deterioration of the shielding member due to fanning heat from the heater can be prevented, and as a result, the occurrence of image failure or the like can be prevented.

Further features of the present invention will become apparent from the following description of exemplary embodiments (with reference to the attached drawings).

BRIEF DESCRIPTION OF THE DRAWINGS

FIG. 4 is a diagram schematically showing the correlation between the on/off states of a main switch and a drum heater switch and the on/off states of a temperature adjustment function performed by the drum heater.

FIGS. 5A and 5B are diagrams schematically showing the placement of the shielding member in the image forming apparatus and an arrangement of a control system, in which FIG. 5A is a diagram showing a retracted state in which the shielding member is not disposed at a shielding position, and FIG. 5B is a diagram showing a shielding state in which the shielding member is disposed at a shielding position.

FIGS. 7A and 7B are diagrams schematically showing the placement of the shielding member and a configuration of a control system in the image forming apparatus according to a second embodiment of the present invention, in which FIG. 7A shows the retracted state in which the shielding member is not disposed at the shielding position, and FIG. 7B shows the shielding state in which the shielding member is disposed at the shielding position.

DESCRIPTION OF THE EMBODIMENTS

The present invention will now be described in detail with reference to the drawings showing embodiments thereof.

Figure 1:
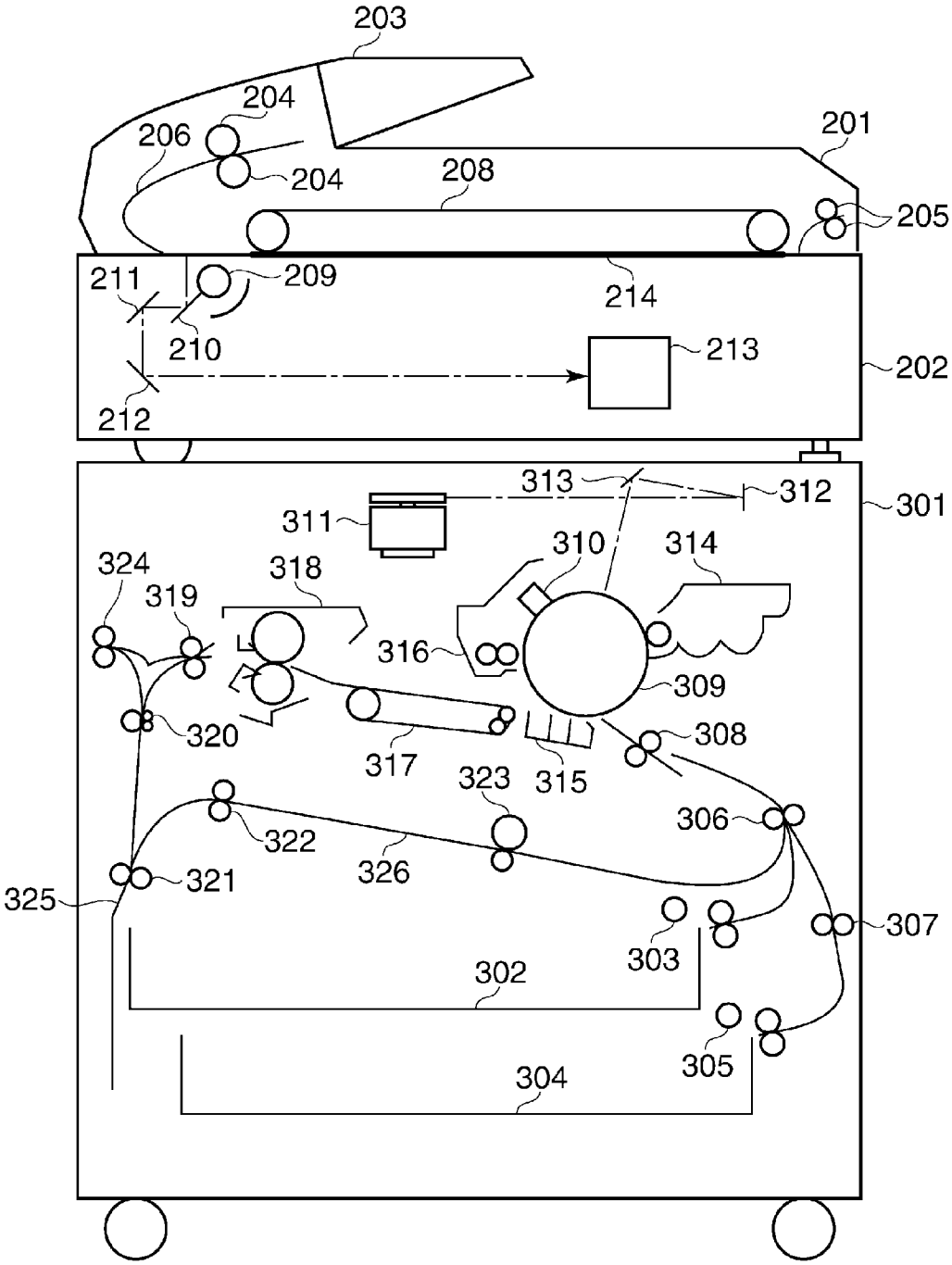
FIG. 1 is a configuration diagram schematically showing an arrangement of an image forming apparatus according to a first embodiment of the present invention.

FIG. 1 is a configuration diagram schematically showing an arrangement of an image forming apparatus according to a first embodiment of the present invention.

Referring to FIG. 1, the image forming apparatus is comprised of an original automatic feeding unit 201, an image reading unit 202, and an image forming unit (image reproducing unit) 301. The original automatic feeding unit 201 has an original mounting unit 203, sheet feeding rollers 204, and so on. The image reading unit 202 has an illumination system 209, an optical system, a photoelectric conversion unit 213, and so on. The image forming unit 301 has a photosensitive drum 309 (photosensitive member), an electrostatic charger 310, a developing device 314, and so on.

A description will now be given of the arrangement and operation of the image forming apparatus, but description of matters not directly related to the gist of the present invention is omitted or simplified. Originals mounted on the original mounting unit 203 of the original automatic feeding unit 201 are separated and fed by the sheet feeding rollers 204 and conveyed to a reading position of the image reading unit 202 via a conveying guide 206. Further, the original is conveyed at a constant speed by a conveying belt 208 and discharged from the apparatus by sheet discharging rollers 205.

In the meantime, the original is illuminated at the reading position of the image reading unit 202 by the illumination system 209. Reflected light from the original is guided to the photoelectric conversion unit 213 by the optical system (reflective mirrors 210, 211, and 212) and converted into an image signal. The photoelectric conversion unit 213 is comprised of lenses, a photoelectric conversion element (CCD), a CCD drive circuit, and so on. It should be noted that original reading modes include a moving original reading mode in which an original is read while being conveyed at a constant speed, and a stationary original reading mode in which an original is mounted and read on an original platen glass 214.

The image signal is subjected to processing by the image processing unit and then modulated to laser light by a semiconductor laser (not shown) or the like in the image forming unit 301. The laser light obtained by modulation is passed through an optical scanning unit, which is comprised of a polygon mirror 311, and mirrors 312 and 313, and exposed to the photosensitive drum 309 whose surface is uniformly electrostatically charged by the electrostatic charger 310 to form an electrostatic latent image. The electrostatic latent image on the photosensitive drum 309 is developed by toner of the developing device 314, and the toner image is transferred to a recording sheet at a transfer positron by a transfer separation device 315.

A recording sheet in a sheet cassette 302 is fed and conveyed by a sheet feeding roller 303 and conveying rollers 306, timed with an image by registration rollers 308, and conveyed to a transfer position. Likewise, a recording sheet in a sheet cassette 304 is fed and conveyed by a sheet feeding roller 305 and conveying rollers 307 and 306, timed with an image by the registration rollers 308, and conveyed to a transfer position. A recording sheet onto which a toner image has been transferred is conveyed to a fixing unit 318 by a conveying belt 317, and toner is fixed on the recording sheet.

When a one-sided printing mode in which an image is formed on one side of a recording sheet is set, the recording sheet with toner fixed thereto is discharged from the apparatus by fixed sheet discharging rollers 319 and sheet discharging rollers 324. When a double-sided printing mode in which images are formed on both sides of a recording sheet is set, the recording sheet with toner fixed thereto is conveyed to an inversion path 325 via the fixed sheet discharging rollers 319, conveying rollers 320, and inversion rollers 321, and conveyed to a double-sided path 326. Further, a toner image is transferred onto the recording sheet at a transfer position via conveying rollers 322, 323, and 306 and the registration rollers 308, and the toner image is fixed on the recording sheet, which is in turn discharged from the apparatus.

Figure 2:
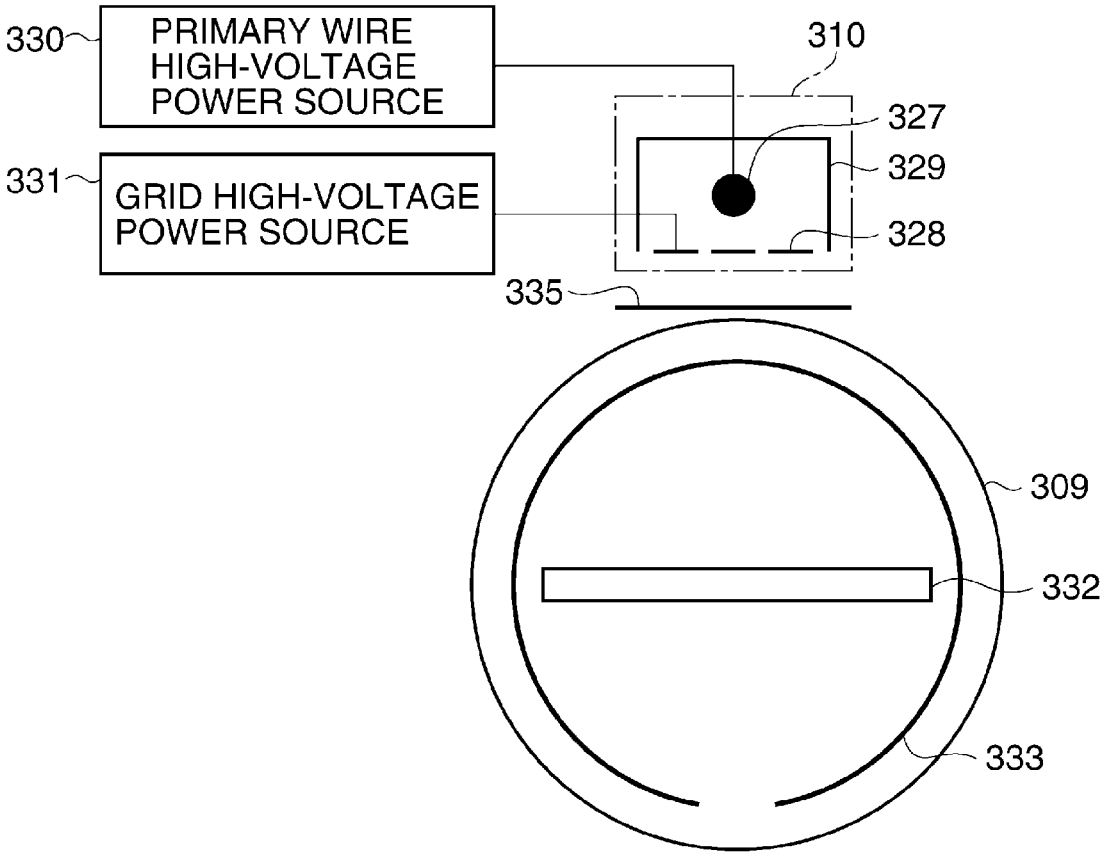
FIG. 2 is a diagram schematically showing the positional relationship among a photosensitive drum, electrostatic charger, and shielding member of the image forming apparatus.

FIG. 2 is a configuration diagram schematically showing the positional relationship between the photosensitive drum, electrostatic charger, and shielding member of the image forming apparatus.

Referring to FIG. 2, the electrostatic charger 310 for uniformly electrostatically charging a photosensitive drum surface by discharge is disposed a predetermined distance away from an outer peripheral surface of the photosensitive drum 309. The electrostatic charger 310 has a metallic wire 327, a grid 328, and a casing 329.

A primary wire high-voltage power source 330 for feeding prescribed electric current is connected to the metallic wire 327. A grid high-voltage power source 331 that applies prescribed voltage for ensuring stabilizing electric current from the metallic wire 327 and ensuring an amount of electric current flowing toward the photosensitive drum 309 is connected to the grid 328. The casing 329 shields an area other than an opening that borders the photosensitive drum 309 from the metallic wire 327.

An electric current of about several hundred μ amperes is passed through the metallic wire 327 to perform corona discharge, and the charge potential of the photosensitive drum 309 is determined by the amount of electric current flowing toward the photosensitive drum 309 from which the amount of electric current flowing into the grid 318 is subtracted. At this time, the charge potential is 400V to 700V.

It should be noted that although in the present embodiment, the electrostatic charger 310 is configured such that the grid 328 is disposed between the metallic wire 327 and the photosensitive drum 309, the present invention is not limited to this. An electrostatic charger that does not have the grid 328 may be used.

The shielding member 335 is provided between the electrostatic charger 310 and the photosensitive drum 309 so as to be movable between a shielding position shown in the figure and a retracted position (not shown). The shielding member 335 is disposed at the shielding position between the grid 328 of the electrostatic charger 310 and the photosensitive drum 309. This can prevent a phenomenon in which ozone products generated in the vicinity of the metallic wire 327 and the grid 328 flow to the photosensitive drum 309 to become attached to the photosensitive drum 309.

The photosensitive drum 309 has therein a drum heater control substrate 332 and a drum heater 333 for heating the photosensitive drum 309 and adjusting the temperature of the photosensitive drum 309. The drum heater control substrate 332 is electrically connected to the drum heater 333, and has a thermo switch that detects the temperature of the drum heater 333. The drum heater 333 is selectively energized or nonenergized based on the temperature detected by the thermo switch.

When the temperature in the photosensitive drum 309 becomes more than a prescribed temperature, the thermo switch is turned off to interrupt the passage of electric current through the drum heater 333. On the other hand, when the temperature in the photosensitive drum 309 becomes not more than the prescribed temperature, the thermo switch is turned on again to feed electric current through the drum heater 333. By repeatedly passing electric current or interrupting the passage of electric current through the drum heater 333, the photosensitive drum 309 can be kept heated.

It should be noted that although in the present embodiment, the temperature of the photosensitive drum 309 is adjusted by selectively passing electric current or interrupting the passage of electric current through the drum heater 333 based on the temperature in the photosensitive drum 309 detected by the thermo switch, the present invention is not limited to this. For example, the drum heater 333 is energized or nonenergized based on the temperature in the photosensitive drum 309 detected by a temperature detecting element such as a thermistor.

Next, a description will now be given of a temperature adjustment function performed by the drum heater 333.

Figure 3:
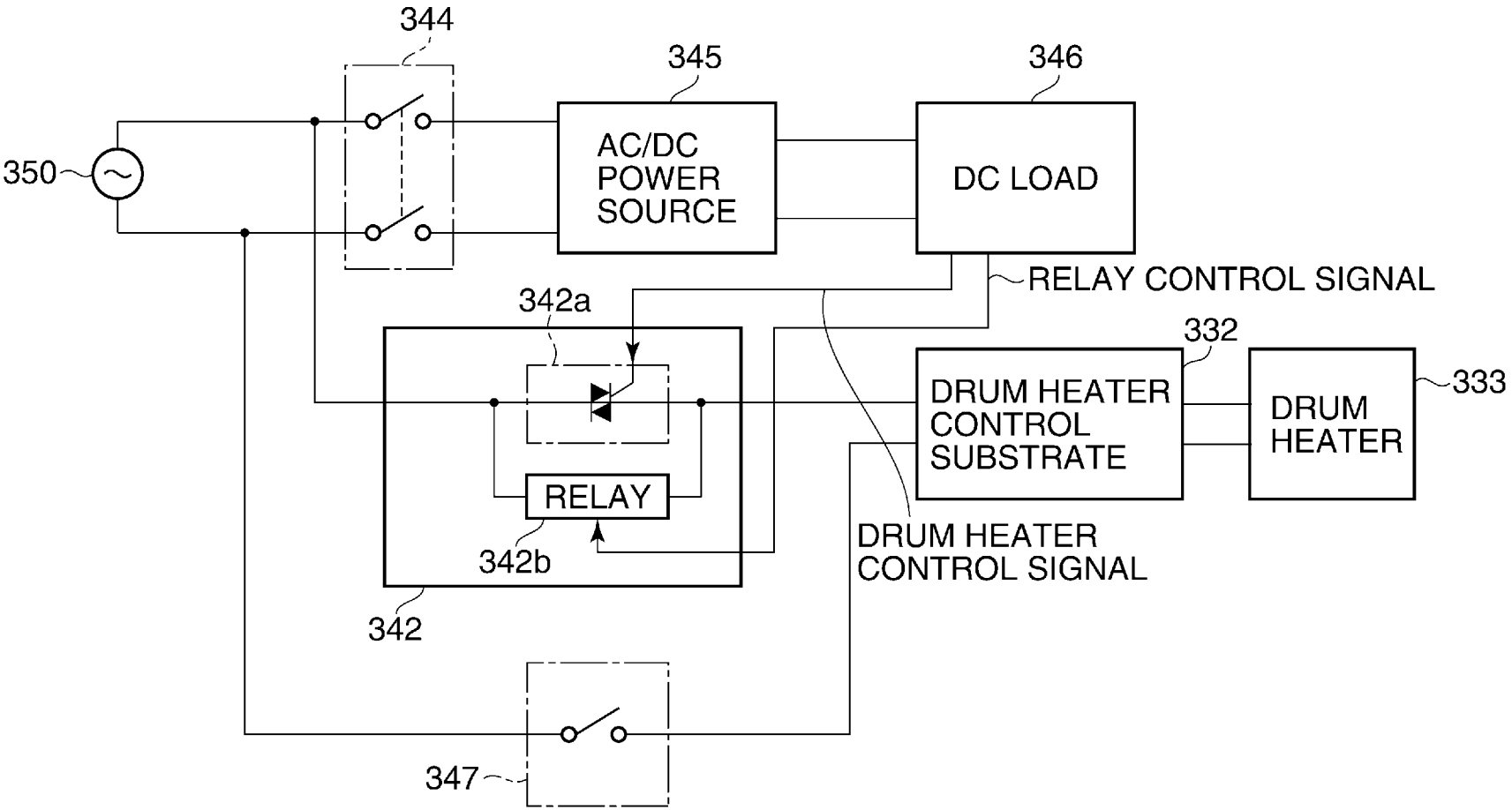
FIG. 3 is a block diagram schematically showing an arrangement of a temperature adjustment function control system of a drum heater in the image forming apparatus.

FIG. 3 is a block diagram schematically showing a temperature adjustment function control system of the drum heater in the image forming apparatus.

Referring to FIG. 3, the image forming apparatus is provided with a main switch 344 for activating the image forming apparatus. When the main switch 344 is turned on, AC voltage is supplied from an AC power source 350 to an AC/DC power source 345. The AC/DC power source 345 converts the supplied AC voltage (AC input) into DC voltage (DC output) of 24V, 12V, or the like, and supplies the DC voltage to various DC loads 346 in the image forming apparatus. For example, supplying DC output to control substrates including a CPU enables the image forming apparatus operable.

The image forming apparatus also has a drum heater drive circuit 342 and a drum heater switch 347. The drum heater drive circuit 342 has a triac 342*a* and a normally-closed relay 342*b*. When the drum heater switch 347 is turned on, the temperature adjustment function of the drum heater 333 is activated even when the main switch 344 is turned off.

When the drum heater switch 347 is on in the state in which the image forming apparatus is activated by turning-on of the main switch 344, a drum heater control signal output from the DC loads 346 such as a CPU selectively turns on or off the temperature adjustment function of the drum heater 333.

Also, when a relay control signal output from the DC load 346 opens the relay 342*b* of the drum heater drive circuit 342, the supply of AC power to the drum heater control substrate 332 can be turned on/off by the drum heater control signal. As a result, the temperature adjustment function of the drum heater 333 can be selectively turned on or off.

Thus, the temperature adjustment function performed of the drum heater 333 using the drum heater switch 347 and the main switch 344 is as shown in FIG. 4.

FIG. 4 is a diagram schematically showing the correlation between the on/off states of a main switch and a drum heater switch and the on/off states of a temperature adjustment function performed by the drum heater.

Referring to FIG. 4, whenever the drum heater switch 347 is off, the temperature adjustment function of the drum heater 333 is off irrespective of the state of the image forming apparatus. When the drum heater switch 347 is on, and the main switch 344 is off, the temperature adjustment function of the drum heater 333 is on. When the drum heater switch 347 is on, and the main switch 344 is on, the temperature adjustment function of the drum heater 333 is selectively turned on or off as controlled by the CPU of the image forming apparatus.

Figure 5A:
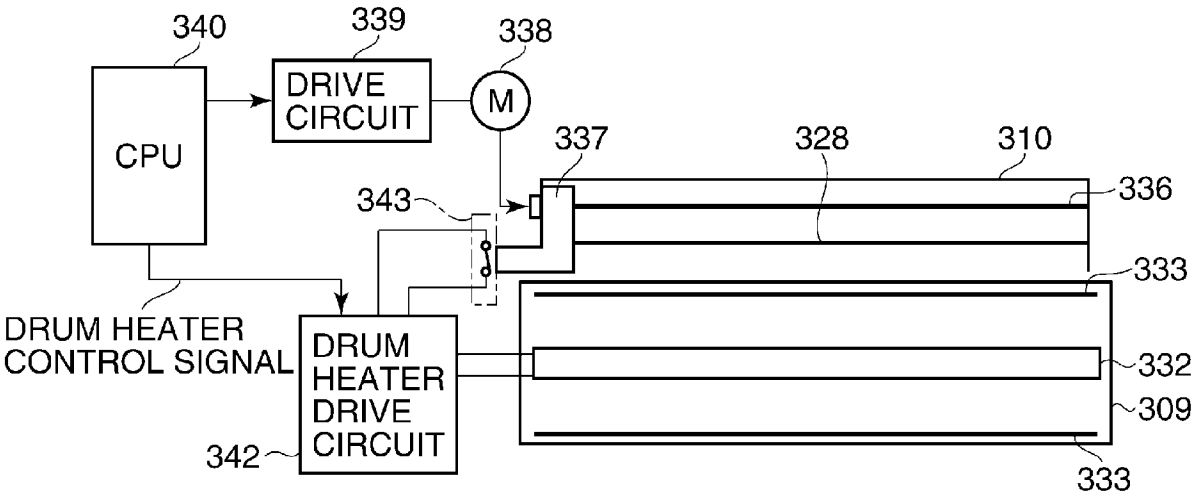
Figure 5B:
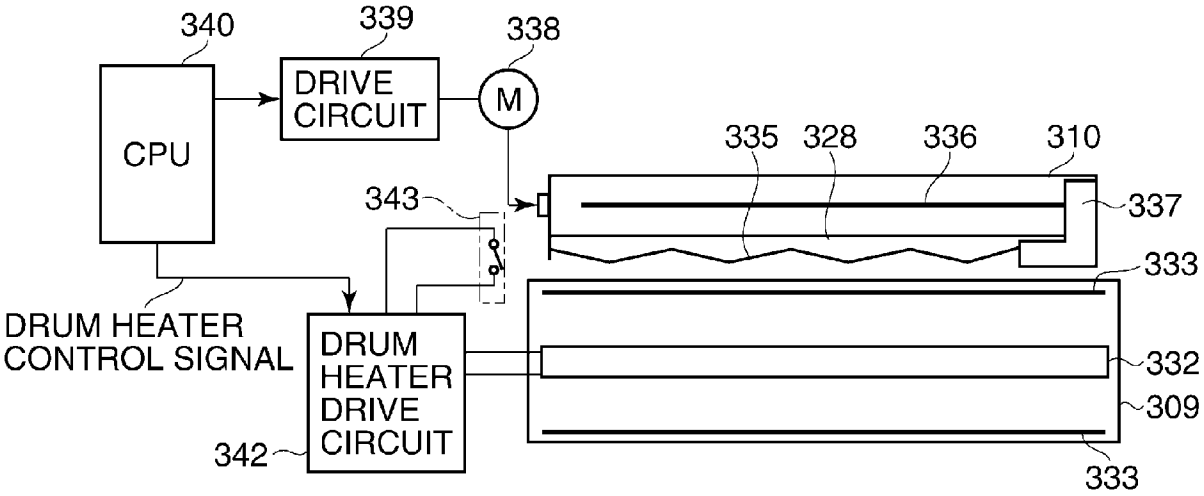

Referring next to FIGS. 5A and 5B, a description will be given of arrangements of the electrostatic charger 310 and the shielding member 335 in the image forming apparatus as viewed in the longitudinal direction thereof, and arrangements of components disposed around them.

In general, for an electrostatic charger that carries out discharge by corona discharge, a cleaning member for cleaning a metallic wire is disposed at such a location as to sandwich the metallic wire so as to prevent the metallic wire from becoming stained or deteriorated. Stains on the metallic wire are removed or the metallic wire is polished by the cleaning member moving to and from the metallic wire at predetermined time intervals. Typically, this cleaning operation is carried out with image adjustment that is carried out every time a predetermined number of prints are made by the image forming apparatus.

FIGS. 5A and 5B are diagrams schematically showing the placement of the shielding member in the image forming apparatus and an arrangement of a control system, in which FIG. 5A is a diagram showing a retracted state in which the shielding member is not disposed at the shielding position, and FIG. 5B is a diagram showing a shielding state in which the shielding member is disposed at the shielding position.

Referring to FIGS. 5A and 5B, a drive shaft 336 is disposed parallel to the grid 328 of the electrostatic charger 310. A cleaning member 337 is a member that cleans the metallic wire 327 (FIG. 2) of the electrostatic charger 310, and is removably mounted on the drive shaft 336. A drive motor 338 rotatively drives the drive shaft 336, causing the cleaning member 337 to reciprocate along the drive shaft 336. A CPU 340 controls the drive motor 338. A drive circuit 339 drives the drive motor 338 by passing electric current through the same.

The direction in which the cleaning member 337 moves can be changed according to the rotating direction of the drive shaft 336. This enables the cleaning member 337 to reciprocate. A microswitch 343 is connected to the drum heater drive circuit 342. A flag is provided at a part of the cleaning member 337 which corresponds to the microswitch 343. The microswitch 343 is selectively short-circuited or opened according to the position of the cleaning member 337.

As shown in FIG. 5B, the shielding member 335 has one end thereof fixed to the cleaning member 337, and the other end thereof fixed to an inner microswitch side of the electrostatic charger 310. The shielding member 335 is configured to be reciprocate in a manner following the cleaning unit 337 caused to reciprocate along the drive shaft 336 by the drive motor 338 (moving unit).

AC power supplied to the drum heater control substrate 332 is passed through the microswitch 343. Because in FIG. 5A, the microswitch 343 is short-circuited, AC power can be passed through the drum heater control substrate 332.

AC power is supplied to the drum heater drive circuit 342. In accordance with a drum heater control signal output from the CPU 340, the supply of AC power to the drum heater control substrate 332 is selectively turned on or off. However, as described above, when the drum heater switch 347 (FIG. 3) is off, AC power is not supplied to the drum heater drive circuit 342 irrespective of an attempt to turn on the drum heater 333 by a drum heater control signal output from the CPU 340.

As shown in FIG. 5A, because the microswitch 343 is short-circuited in the retracted state where the shielding member 335 is not disposed between the electrostatic charger 310 and the photosensitive drum 309, the temperature adjusting function of the drum heater 333 is enabled.

Next, a description will be given of the shielding state shown in FIG. 5B in which the shielding member 335 is disposed between the electrostatic charger 310 and the photosensitive drum 309.

The cleaning member 337 having been at a left end of the electrostatic charger 310 in FIG. 5A moves to a right end of the electrostatic charger 310 as shown in FIG. 5B, bringing the shielding member 335 into a shielding state of shielding the electrostatic charger 310 and the photosensitive drum 309 from each other. The position indicated in FIG. 5B is regarded as a shielding position for the shielding member 335. Referring to FIG. 5B, because the microswitch 343 is open, the temperature adjustment function of the drum heater 333 is disabled irrespective of whether the drum heater switch 347 is on or off and a control signal from the CPU 340.

Next, a description will be given of how to use two type of image deletion preventive functions (an image deletion preventive function using the temperature adjustment function of the drum heater 333, and an image deletion preventive function using the shielding mechanism between the electrostatic charger 310 and the photosensitive drum 309).

First, a description will be given of a case where basically the main switch 344 (FIG. 3) of the image forming apparatus is not turned off, and the image forming apparatus is caused to stand by in sleep state when it is not in use.

In general, a multi-functional image forming apparatuses (multi-functional peripherals) installed at company offices has a facsimile function and an externally-connecting function using a LAN or the like so as to constantly receive information from outside. For this reason, when a copying function or a printing function of the image forming apparatus is used, the image forming apparatus is brought into a standby state, and otherwise, the image forming apparatus is caused to stand by in a sleep state in which the power to unnecessary portions except an external communication port or the like is off.

When the image forming apparatus is in the standby state, excellent images can always be obtained by the temperature adjusting function of the drum heater 333 even when the usage environment of the image forming apparatus changes. When the image forming apparatus is in the sleep state, the shielding mechanism of the shielding member 335 shielding the electrostatic charger 310 and the photosensitive drum 309 from each other is used.

Figure 6:
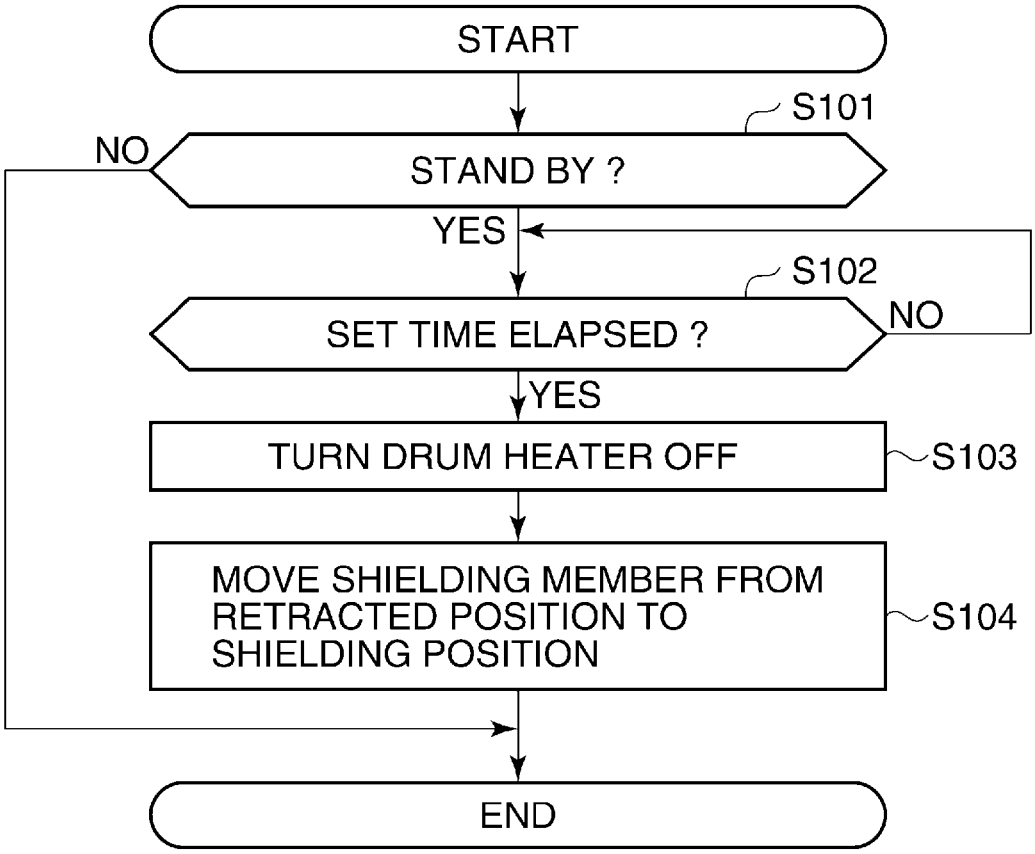
FIG. 6 is a flowchart showing how the image forming apparatus is brought into sleep state.

Referring next to FIG. 6, a description will be given of exemplary control performed by the CPU 340 of the image forming apparatus to bring the image forming apparatus into the sleep state.

FIG. 6 is a flowchart showing how the image forming apparatus is brought into sleep state.

Referring to FIG. 6, the CPU 340 (control unit) of the image forming apparatus determines whether or not the image forming apparatus is currently in the standby state (step S101). When the image forming apparatus is currently in the standby state, the CPU 340 determines whether or not a set time period has elapsed since the image forming apparatus was brought into the standby state (step S102). Here, a user or serviceman can set the set time period using a console or the like of the image forming apparatus according to the frequency of use by the user.

When the set time period has not elapsed since the image forming apparatus was brought into the standby state, the CPU 340 stands by until the set time period elapses. When the set time period has elapsed since the image forming apparatus was brought into the standby state, the CPU 340 turns off the drum heater 333 by interrupting the passage of electric current through the drum heater 333 (step S103).

The CPU 340 then moves the shielding member 335 from the retracted position to the shielding position (FIG. 5B) (step S104). After that, the CPU 340 turns off the power except for the minimum necessary portion (externally-connecting function performed by a LAN or the like) of the image forming apparatus.

For example, assume that the user turns off the main switch 344 of the image forming apparatus and turns on the drum heater switch 347 so as to prevent image deletion instead of leaving the image forming apparatus in sleep state as usual. In this case, the shielding member 335 shields the electrostatic charger 310 and the photosensitive drum 309 from each other, and the temperature adjusting function of the drum heater 333 is enabled.

However, when the shielding member 335 shields the electrostatic charger 310 and the photosensitive drum 309 from each other as shown in FIG. 5B, the passage of electric current through the drum heater 333 is interrupted by the microswitch 343. Thus, the shielding member 335 can be prevented from deteriorating due to fanning heat from the photosensitive drum 309 to the shielding member 335.

Next, a description will be given of a case where basically, the main switch 344 is turned on only when the image forming apparatus is in use, and the main switch 344 is turned off when the image forming apparatus is not in use.

In a case where the user always turns off the main switch 344 immediately when the image forming apparatus is not in use, the supply of power to the image forming apparatus is shut off. For this reason, the shielding mechanism of the shielding member 335 shielding the electrostatic charger 310 and the photosensitive drum 309 from each other cannot be used in the image forming apparatus.

Thus, in order to prevent image deletion, the temperature holding function of the drum heater 333 is used. For example, even when the main switch 344 is suddenly turned off, the temperature holding function of the drum heater 333 can be activated to prevent image deletion as long as the drum heater switch 347 is on.

For example, assume that after a serviceman removes the electrostatic charger 310 from the image forming apparatus to carry out maintenance, he accidentally puts the shielding member 335 being at the retracted position to the shielding position by mistake and puts the electrostatic charger 310 back into the image forming apparatus.

However, when the shielding member 335 shields the electrostatic charger 310 and the photosensitive drum 309 from each other as shown in FIG. 5B, the passage of electric current through the drum heater 333 is interrupted by the microswitch 343. Thus, the shielding member 335 can be prevented from deteriorating due to fanning heat from the photosensitive drum 309 to the shielding member 335.

As described above, the passage of electric current and the interruption of the passage of electric current through the drum heater 333 are controlled via the microswitch 343 which changes in condition according to the position (retracted position/shielding position) of the shielding member 355 in image forming apparatus. As a result, electric current can be passed through the drum heater 333 only when the shielding member 335 lies at the retracted position.

Therefore, the effects described hereafter can be obtained even when a user or serviceman changes the retracted position/shielding position of the shielding member 335 and the on/off states of the drum heater switch 347 after the image forming apparatus is brought into sleep state or power-off state. The shielding member 335 can be prevented from deteriorating due to fanning heat from the drum heater 333, and as a result, image failure or the like of the image forming apparatus can be prevented.

A second embodiment of the present invention differs from the first embodiment described above in points described below with reference to FIGS. 7A, 7B, and 8. Other elements of the present embodiment are identical with the corresponding ones of the first embodiment described above (FIGS. 1 to 3), and therefore, description thereof is omitted.

Figure 7A:
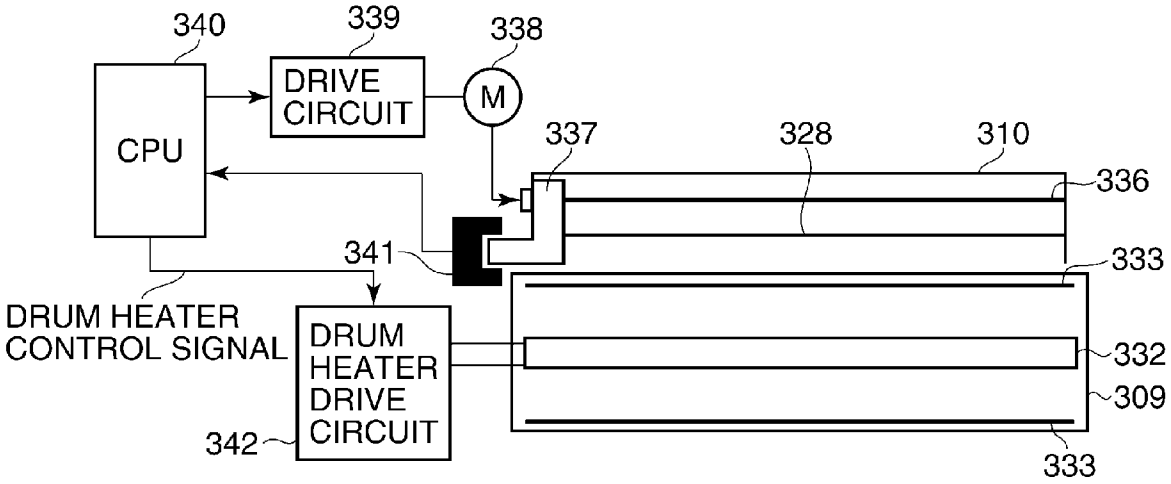
Figure 7B:
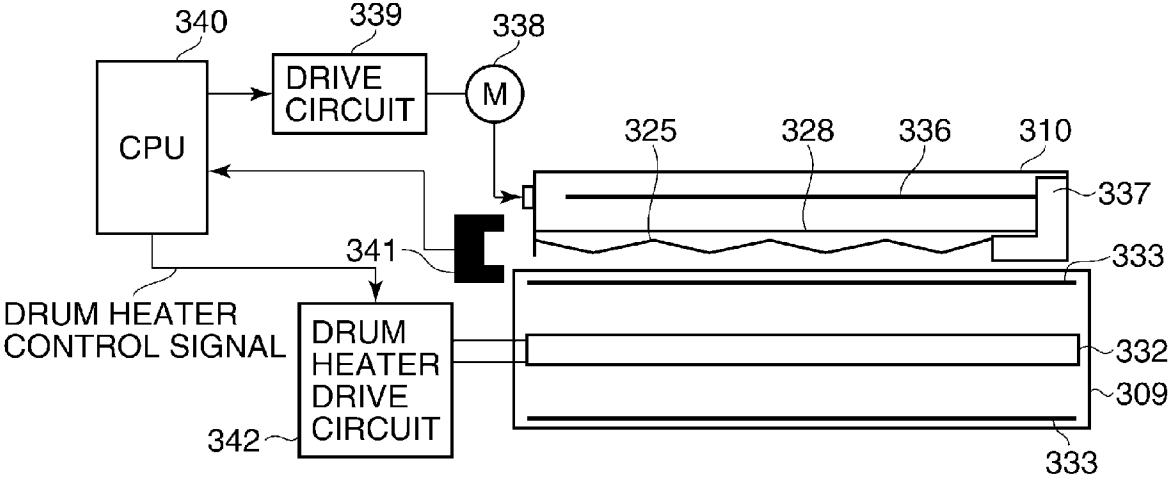

FIGS. 7A and 7B are diagrams schematically showing the placement of the shielding member and a configuration of a control system in the image forming apparatus according to the present embodiment, in which FIG. 7A shows the retracted state in which the shielding member is not disposed at the shielding position, and FIG. 7B shows the shielding state in which the shielding member is disposed at the shielding position.

Referring to FIGS. 7A and 7B, in the present embodiment, a photo-interrupter 341 is provided in place of the microswitch 343 provided in the first embodiment shown in FIGS. 5A and 5B. Elements of the present embodiment other than the photo-interrupter 342 are the same as those in FIGS. 5A and 5B, and therefore, the same components as those in FIGS. 7A and 7B are designated by the same reference symbols, detailed description of which, therefore, is omitted.

The photo-interrupter 341 is connected to the CPU 340. A flag is provided at a part of the cleaning member 337 which corresponds to the photo-interrupter 341. The photo-interrupter 341 is brought into illumination state or light-shielding state according to the position of the cleaning member 337. Based on a detection signal from the photo-interrupter 341, the CPU detects whether or not the cleaning member 337 lies at the shielding position or the retracted position.

It should be noted that although in the present embodiment, the photo-interrupter 341 is used as the detecting unit that detects the position of the shielding member 335, the present invention is not limited to this, but another optical sensor (reflective optical sensor) or the microswitch 343 of the first embodiment may be used as the detecting unit because it is only necessary to notify the CPU 340 of the position of the shielding member 335 by a detection signal.

AC power is supplied to the drum heater drive circuit 342. In accordance with a control signal output from the CPU 340, the supply of AC power to the drum heater control substrate 332 is selectively turned on or off. However, as described above, when the drum heater switch 347 is off, AC power is not supplied to the drum heater drive circuit 342 irrespective of an attempt to turn on the drum heater 333 by a control signal output from the CPU 340.

Also, the CPU 340 and the photo-interrupter 341 are configured as described hereafter so as to detect the position of the shielding member 335 and selectively turn on and off the power to the drum heater control substrate 332 even when the main switch 344 of the image forming apparatus is off. Specifically, the CPU 340 and the photo-interrupter 341 are capable of operating using power supplied by turning on the drum heater switch 347.

Next, a description will be given of a case where basically, the main switch 344 is not turned off, and the image forming apparatus is caused to stand by when it is not in use.

For example, assume that the user turns off the main switch 344 of the image forming apparatus and turns on the drum heater switch 347 so as to prevent image deletion instead of leaving the image forming apparatus in sleep state as usual. In this case, the shielding member 335 shields the electrostatic charger 310 and the photosensitive drum 309 from each other, and the temperature adjusting function of the drum heater 333 is enabled.

A description will now be given of how the position of the shielding member 335 is detected by the CPU 340 of the image forming apparatus.

Figure 8:
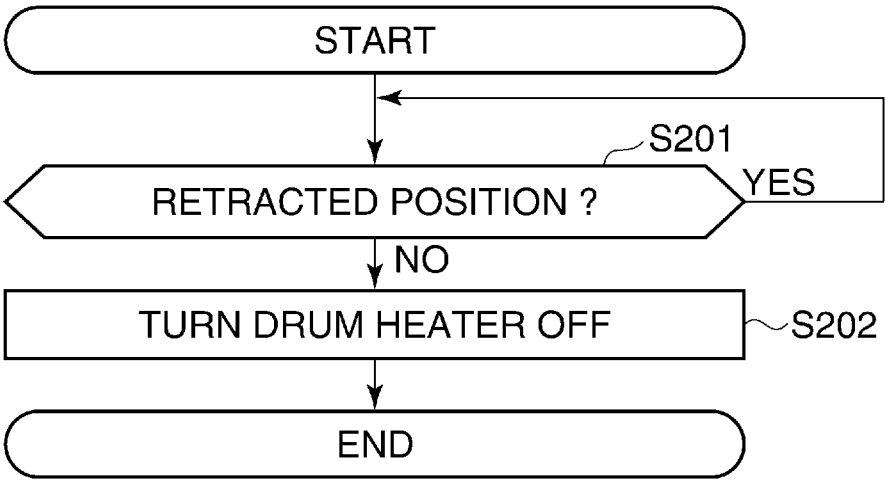
FIG. 8 is a flowchart showing how the position of the shielding member of the image forming apparatus is detected.

FIG. 8 is a flowchart showing how the position of the shielding member is detected in the image forming apparatus.

Referring to FIG. 8, the CPU 340 of the image forming apparatus constantly monitors whether or not the shielding member 335 is at the retracted position based on detection signals from the photo-interrupter 341 (step S201). When the shielding member 335 lies in the retracted state where it is disposed at the retracted position (FIG. 7B), the shielding member 335 not being at the retracted position can be detected based on a detection signal from the photo-interrupter 341.

Therefore, the CPU 340 determines that the shielding member 335 is not at the retracted position (NO in the step S201), the passage of electric current through the drum heater 333 is turned off (step S202). As a result, the shielding member 335 can be prevented from deteriorating due to fanning heat from the photosensitive drum 309.

Next, a description will be given of a case where basically, the main switch 344 is turned on only when the image forming apparatus is used and the main switch 244 is turned off when the image forming apparatus is not in use.

For example, assume that after a serviceman removes the electrostatic charger 310 from the image forming apparatus to carry out maintenance, he accidentally puts the shielding member 335 being at the retracted position to the shielding position by mistake and puts the electrostatic charger 310 back into the image forming apparatus.

Referring to FIG. 8, the CPU 340 of the image forming apparatus constantly monitors whether or not the shielding member 335 is at the retracted position based on detection signals from the photo-interrupter 341 (step S201). When the shielding member 335 lies in the retracted state of being at the retracted position (FIG. 7B), the shielding member 335 not being at the retracted position can be detected based on a detection signal from the photo-interrupter 341.

Therefore, the CPU 340 determines that the shielding member 335 is not at the retracted position (NO in the step S201), the passage of electric current through the drum heater 333 is turned off (step S202). As a result, the shielding member 335 can be prevented from deteriorating due to fanning heat from the photosensitive drum 309.

As described above, according to the present embodiment, the position of the shielding member 335 is constantly monitored by detection signals from the photo-interrupter 341 in the image forming apparatus, and the CPU 340 performs control to selectively pass electric current or interrupt the passage of electric current through the drum heater 333 according to the position of the shielding member 335. Thus, only when the shielding member 335 is at the retracted position, electric current cab be passed through the drum heater 333.

Therefore, the effects described hereafter can be obtained even when a user or serviceman changes the retracted position/shielding position of the shielding member 335 and the on/off of the drum heater switch 347 after the image forming apparatus is brought into sleep state or power-off state. The shielding member 335 can be prevented from deteriorating due to fanning heat from the drum heater 333, and as a result, image failure or the like of the image forming apparatus can be prevented.

It should be noted that although in the above description, when the shielding member 335 lies at the shielding position, the photosensitive drum 309 is not heated by the drum heater 333, the amount of heat added to the photosensitive drum 309 by the drum heater 333 may be reduced. Specifically, when the shielding member 335 lies at the shielding position, the amount of heat added to the photosensitive drum 309 by the drum heater 333 may be reduced by making the amount of electric current passed through the drum heater 333 smaller than in the case where the shielding member 335 lies at the retracted position.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., a computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-003079 filed Jan. 11, 2011, which is hereby incorporated by reference herein in its entirety.

What is claimed is:

1. An image forming apparatus comprising:

a photosensitive member;

a corona electrostatic charger configured to have an opening facing said photosensitive member and electrostatically charge said photosensitive member via the opening;

a toner image forming unit configured to form a toner image on said photosensitive member electrostatically charged by said corona electrostatic charger;

a sheet-shaped shielding member configured to shield the opening;

a moving unit configured to move said shielding member between a shielding position in which said shielding member shields the opening and a retracted position in which said shielding member is retracted from the shielding position;

a main switch configured to activate the image forming apparatus by being turned on;

a heater configured to heat said photosensitive member by being supplied with a voltage;

a power source configured to supply the voltage to said heater so that electric current is passed through said heater;

a heater switch configured to allow the electric current to pass through said heater from said power source by being turned on; and a micro switch configured to allow passage of the electric current to said heater due to turning on of said heater switch in a case where said main switch is turned off and said shielding member is disposed at the retracted position, and interrupt passage of the electric current to said heater due to turning on of said heater switch in a case where said main switch is turned off and said shielding member is disposed at the shielding position.

* * * * *